US012805572B2

(12) United States Patent
Potter

(10) Patent No.: US 12,805,572 B2
(45) Date of Patent: Nov. 24, 2026

(54) AEROSOL PROVISION SYSTEM

(71) Applicant: Nicoventures Trading Limited, London (GB)

(72) Inventor: Mark Potter, London (GB)

(73) Assignee: Nicoventures Trading Limited, London (GB)

( * ) Notice: Subject to any disclaimer, the term of this patent is extended or adjusted under 35 U.S.C. 154(b) by 362 days.

(21) Appl. No.: 18/290,699

(22) PCT Filed: Jul. 6, 2022

(86) PCT No.: PCT/GB2022/051733
§ 371 (c)(1),
(2) Date: Jan. 19, 2024

(87) PCT Pub. No.: WO2023/002152
PCT Pub. Date: Jan. 26, 2023

(65) Prior Publication Data

US 2025/0089792 A1 Mar. 20, 2025

(30) Foreign Application Priority Data

Jul. 19, 2021 (GB) ..... 2110349

(51) Int. Cl.
*A24F 40/485* (2020.01)
*A24F 40/42* (2020.01)
*A24F 40/51* (2020.01)

(52) U.S. Cl.
CPC ..... *A24F 40/485* (2020.01); *A24F 40/42* (2020.01); *A24F 40/51* (2020.01)

(58) Field of Classification Search
None
See application file for complete search history.

(56) References Cited

U.S. PATENT DOCUMENTS

2016/0324212 A1 11/2016 Cameron
2018/0153220 A1 6/2018 Verleur et al.
(Continued)

FOREIGN PATENT DOCUMENTS

CN 108289504 A 7/2018
JP 2020501541 A 1/2020
WO 2021105242 A1 6/2021

OTHER PUBLICATIONS

Office Action received for Korean Patent Application No. 10-2024-7001932, mailed on May 1, 2026, 5 pages (2 pages of English Translation and 2 pages of Official Copy).
(Continued)

*Primary Examiner* — Dennis R Cordray
(74) *Attorney, Agent, or Firm* — MERCHANT & GOULD P.C.

(57) ABSTRACT

An aerosol provision system including a vaporizer for vaporizing aerosolizable material, and an air inlet channel for delivering air to the vaporizer, wherein the air inlet channel includes an opening which is configured to be covered when the aerosol provision system is in a first configuration, and which is configured to be uncovered when the aerosol provision system is in a second configuration, wherein the opening is configured to allow air to bypass the vaporizer when the opening is uncovered, by bypassing out from the air inlet channel through the opening, for inhibiting the delivery of vaporized aerosolizable material when the aerosol provision system is in the second configuration.

16 Claims, 6 Drawing Sheets

(56) References Cited

U.S. PATENT DOCUMENTS

| | | | | |
|---|---|---|---|---|
| 2019/0001087 | A1 | 1/2019 | Davidson et al. | |
| 2020/0345075 | A1 | 11/2020 | Hepworth | |
| 2023/0032298 | A1* | 2/2023 | Thornton | A24F 40/20 |

OTHER PUBLICATIONS

JP Office Action in Japanese Application No. 2024-502073, dated Feb. 26, 2025, 21 pages.
PCT International Search Report and Written Opinion in International Appln. No. PCT/GB2022/051733, dated Sep. 20, 2022, 12 pages.
PCT International Preliminary Report on Patentability in International Appln. No. PCT/GB2022/051733, mailed Feb. 1, 2024, 7 pages.

* cited by examiner

AEROSOL PROVISION SYSTEM

RELATED APPLICATIONS

The present application is a National Phase Entry of PCT Application PCT/GB2022/051733 filed Jul. 6, 2022, which claims priority to GB Application No. 2110349.4 filed Jul. 19, 2021, each of which is hereby incorporated by reference in their entirety.

FIELD

The present disclosure relates to aerosol provision systems such as, but not limited to, nicotine delivery systems (e.g. electronic cigarettes and the like).

BACKGROUND

Electronic aerosol provision systems such as electronic cigarettes (e-cigarettes) generally contain aerosolizable material, such as a reservoir of fluid or liquid containing a formulation, typically but not necessarily including nicotine, or a solid material such as a tobacco-based product, from which a vapor/aerosol is generated for inhalation by a user, for example through heat vaporization. Thus, an aerosol provision system will typically comprise a vaporizer, e.g. a heating element, arranged to vaporize a portion of aerosolizable material to generate a vapor.

Once a vapor has been generated, the vapor may be passed through flavoring material to add flavor to the vapor, after which the (flavored) vapor may be then delivered to a user via a mouthpiece or outlet from the aerosol provision system.

It is common for aerosol provision systems to comprise a modular assembly, often having two main functional parts, namely a control unit/body, and disposable/replaceable consumable part. Such a consumable part, in some embodiments, may take the resemblance of a cigarette.

Various approaches are described herein which seek to improve existing aerosol provision systems, such as those outlined above, in a number of different ways.

SUMMARY

According to a first aspect of certain embodiments there is provided an aerosol provision system comprising a vaporizer for vaporizing aerosolizable material, and an air inlet channel for delivering air to the vaporizer, wherein the air inlet channel comprises an opening which is configured to be covered when the aerosol provision system is in a first configuration, and which is configured to be uncovered when the aerosol provision system is in a second configuration, wherein the opening is configured to allow air to bypass the vaporizer when the opening is uncovered, by bypassing out from the air inlet channel through the opening, for inhibiting the delivery of vaporized aerosolizable material when the aerosol provision system is in the second configuration.

According to a second aspect of certain embodiments there is a method for controlling the delivery of vaporized aerosolizable material in an aerosol provision system comprising a vaporizer and an air inlet channel, wherein the method comprises:

moving the aerosol provision system between a first configuration, in which an opening of the air inlet channel is covered for allowing air passing through the air inlet channel to reach the vaporizer, and a second configuration in which the opening is uncovered to allow air to bypass the vaporizer by bypassing out from the air inlet channel through the opening.

It will be appreciated that features and aspects of the invention described above in relation to the various aspects of the invention are equally applicable to, and may be combined with, embodiments of the invention according to other aspects of the invention as appropriate, and not just in the specific combinations described herein.

BRIEF DESCRIPTION OF THE DRAWINGS

Embodiments of the invention will now be described, by way of example only, with reference to the accompanying drawings, in which.

DETAILED DESCRIPTION

Figure 1:
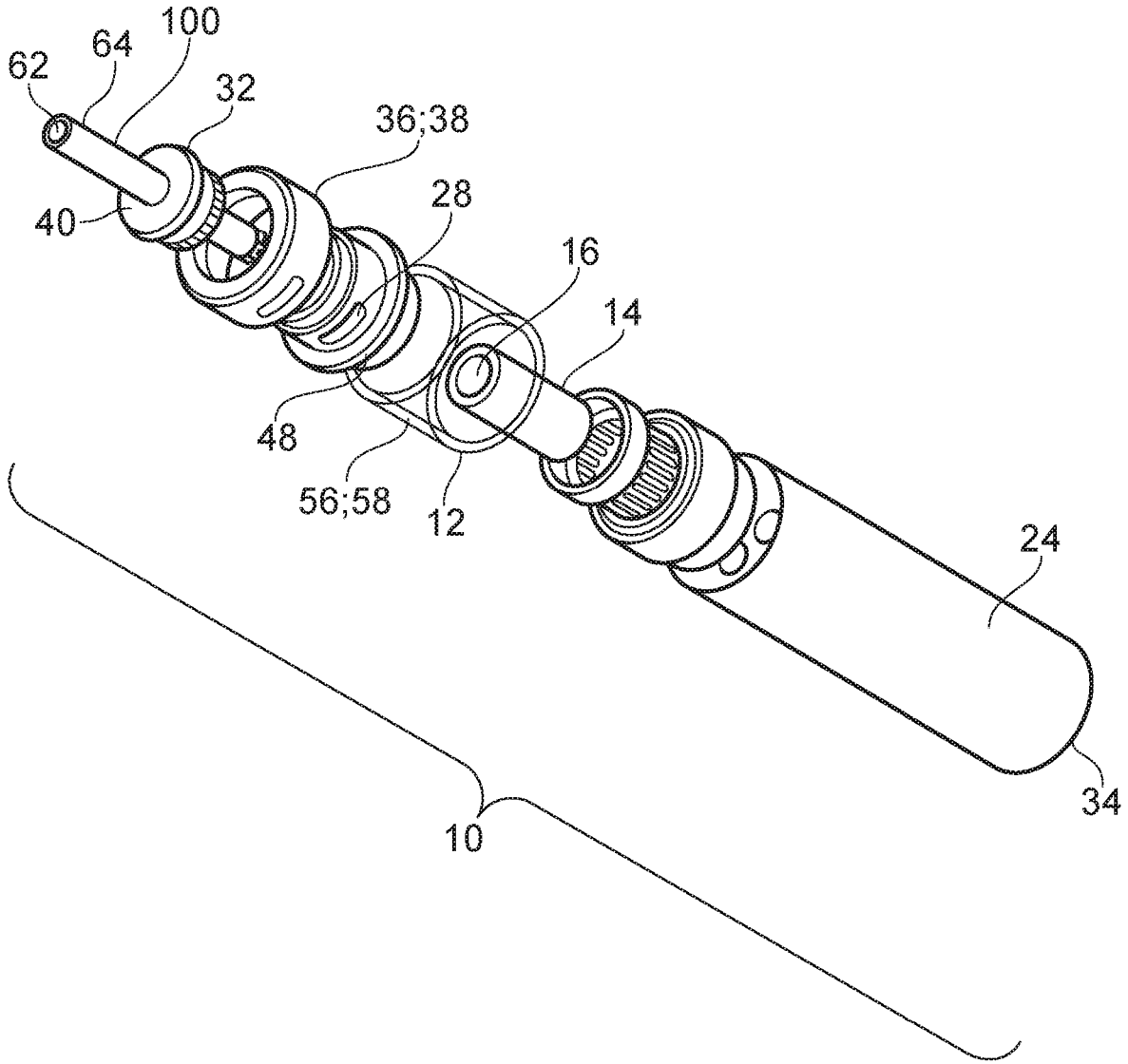
FIG. 1 schematically represents a perspective exploded view of an aerosol provision system, comprising a consumable part and a body, in accordance with certain embodiments of the disclosure.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to non-combustible aerosol provision systems, which may also be referred to as aerosol provision systems, such as e-cigarettes. According to the present disclosure, a "non-combustible" aerosol provision system is one where a constituent aerosolizable material of the aerosol provision system (or component thereof) is not combusted or burned in order to facilitate delivery to a user. Aerosolizable material, which also may be referred to herein as aerosol generating material or aerosol precursor material, is material that is capable of generating aerosol, for example when heated, irradiated or energized in any other way.

Throughout the following description the term "e-cigarette" or "electronic cigarette" may sometimes be used, but it will be appreciated this term may be used interchangeably with aerosol provision system/device and electronic aerosol provision system/device. An electronic cigarette may also known as a vaping device or electronic nicotine delivery system (END), although it is noted that the presence of nicotine in the aerosolizable material is not a requirement.

In some embodiments, the non-combustible aerosol provision system is a hybrid system to generate aerosol using a combination of aerosolizable materials, one or a plurality of which may be heated. In some embodiments, the hybrid system comprises a liquid or gel aerosolizable material and a solid aerosolizable material. The solid aerosolizable material may comprise, for example, tobacco or a non-tobacco product.

Typically, the non-combustible aerosol provision system may comprise a consumable part and a device/body which is configured to releasably engage with the consumable part.

The aerosol provision system may be provided with a means for powering a vaporizer therein, and there may be provided an aerosolizable material transport element for receiving the aerosolizable material that is to be vaporized. The aerosol provision system may also be provided with a reservoir for containing aerosolizable material, and in some embodiments a further reservoir for containing flavoring material for flavoring a generated vapor from the aerosol provision system.

In some embodiments, the vaporizer may be a heater/heating element capable of interacting with the aerosolizable material so as to release one or more volatiles from the aerosolizable material to form a vapor/aerosol. In some embodiments, the vaporizer is capable of generating an aerosol from the aerosolizable material without heating. For example, the vaporizer may be capable of generating a vapor/aerosol from the aerosolizable material without applying heat thereto, for example via one or more of vibrational, mechanical, pressurisation or electrostatic means.

In some embodiments, the substance to be delivered may be an aerosolizable material which may comprise an active constituent, a carrier constituent and optionally one or more other functional constituents.

The active constituent may comprise one or more physiologically and/or olfactory active constituents which are included in the aerosolizable material in order to achieve a physiological and/or olfactory response in the user. The active constituent may for example be selected from nutraceuticals, nootropics, and psychoactives. The active constituent may be naturally occurring or synthetically obtained. The active constituent may comprise for example nicotine, caffeine, taurine, theine, a vitamin such as B6 or B12 or C, melatonin, a cannabinoid, or a constituent, derivative, or combinations thereof. The active constituent may comprise a constituent, derivative or extract of tobacco or of another botanical. In some embodiments, the active constituent is a physiologically active constituent and may be selected from nicotine, nicotine salts (e.g. nicotine ditartrate/nicotine bitartrate), nicotine-free tobacco substitutes, other alkaloids such as caffeine, or mixtures thereof.

In some embodiments, the active constituent is an olfactory active constituent and may be selected from a "flavor" and/or "flavorant" which, where local regulations permit, may be used to create a desired taste, aroma or other somatosensorial sensation in a product for adult consumers. In some instances such constituents may be referred to as flavors, flavorants, flavoring material, cooling agents, heating agents, and/or sweetening agents. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus Mentha, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gasone or more of extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In some embodiments, the flavoring material (flavor) may comprise menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

The carrier constituent may comprise one or more constituents capable of forming an aerosol. In some embodiments, the carrier constituent may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

The one or more other functional constituents may comprise one or more of pH regulators, coloring agents, preservatives, binders, fillers, stabilizers, and/or antioxidants.

As noted above, aerosol provision systems (e-cigarettes) often comprise a modular assembly including both a reusable part (body/device) and a replaceable consumable (cartridge) part. Devices conforming to this type of two-part modular configuration may generally be referred to as two-part devices. It is also common for electronic cigarettes to have a generally elongate shape. For the sake of providing a concrete example, certain embodiments of the disclosure described herein comprise this kind of generally elongate two-part device employing consumable parts. However, it will be appreciated the underlying principles described herein may equally be adopted for other electronic cigarette configurations, for example modular devices comprising more than two parts, as devices conforming to other overall shapes, for example based on so-called box-mod high performance devices that typically have a more boxy shape.

Figure 2:
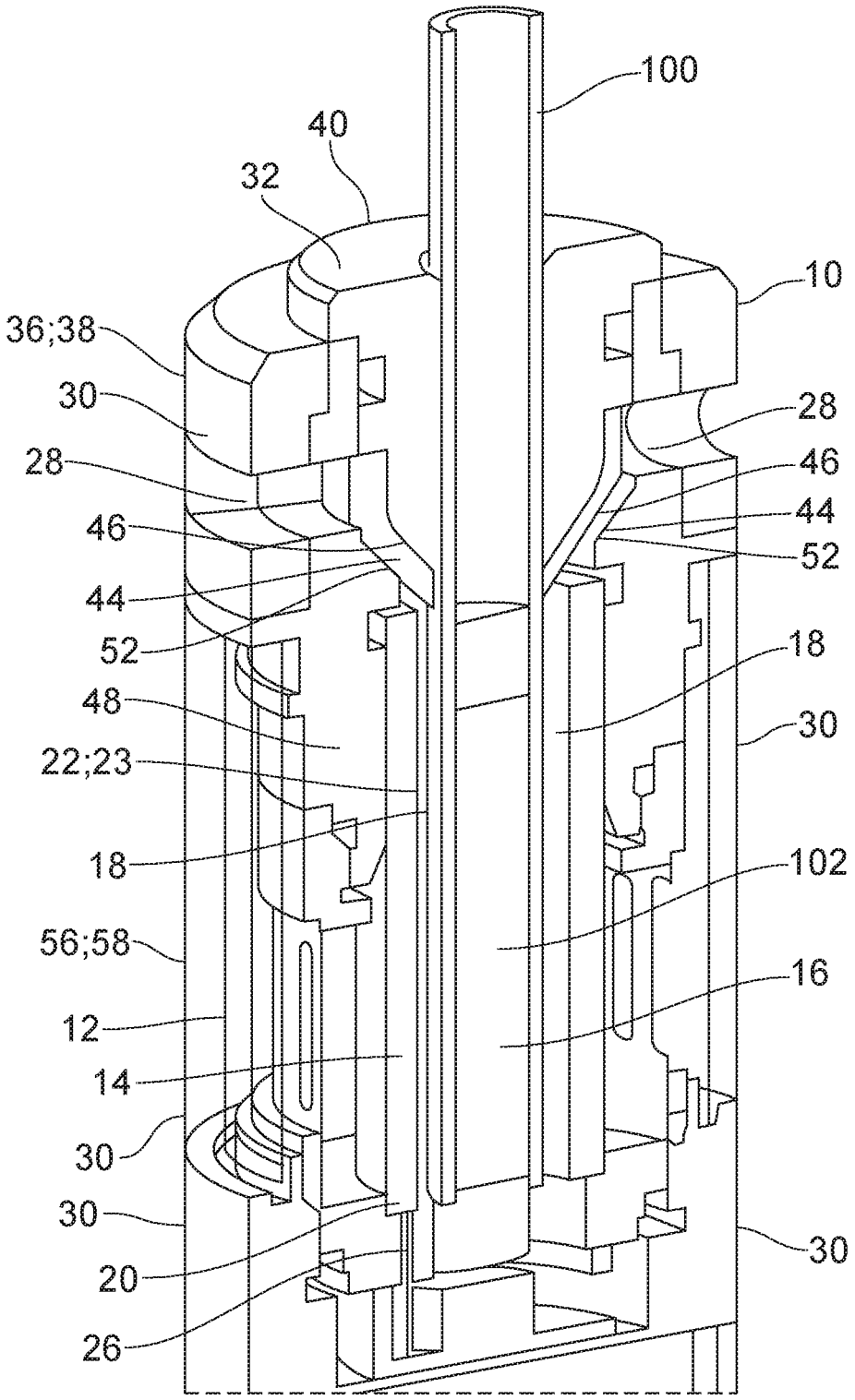
FIG. 2 schematically represents a cross-sectional perspective view of a portion of the aerosol provision system from FIG. 1, in accordance with certain embodiments of the disclosure.
Figure 3:
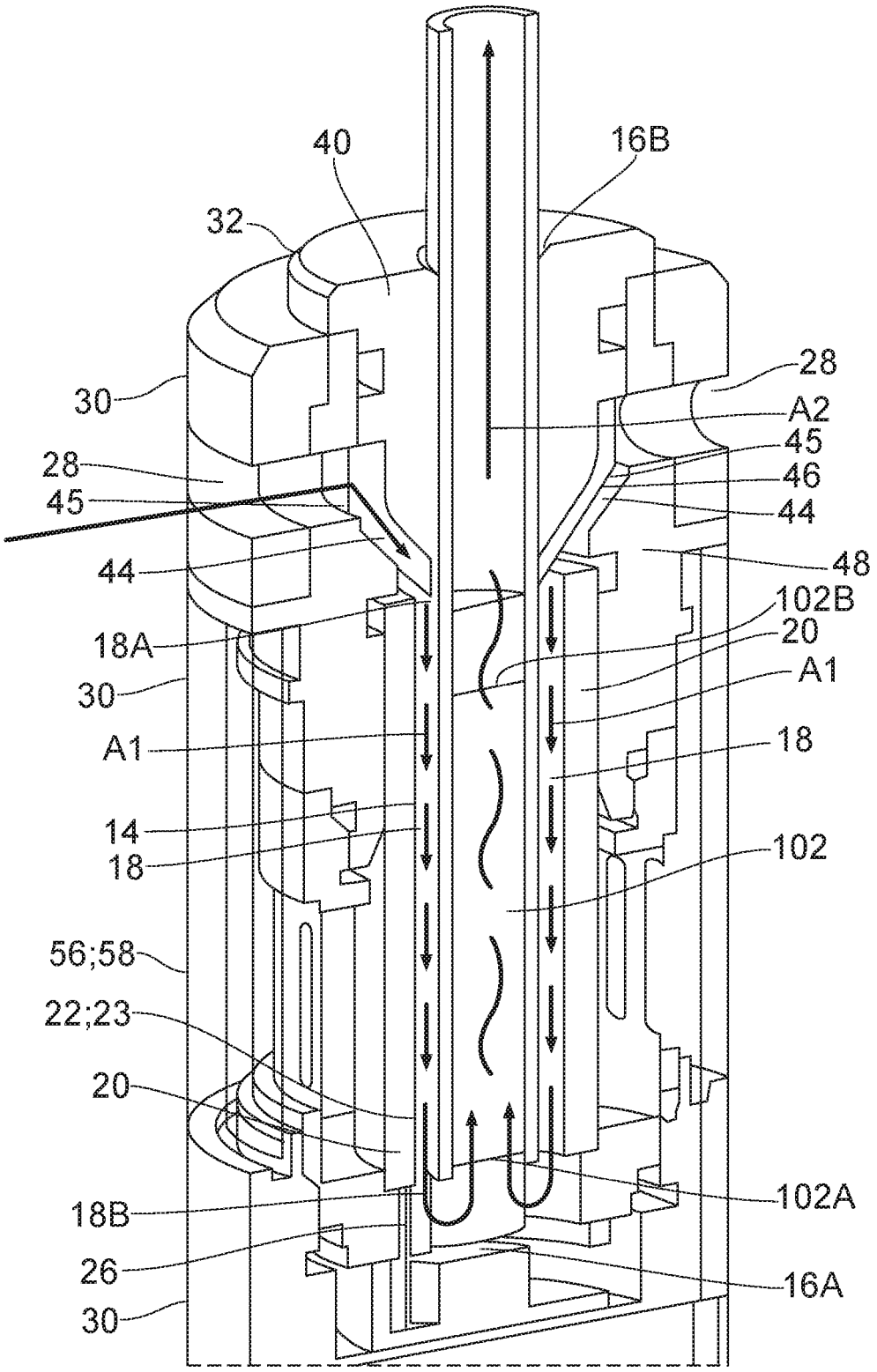
FIG. 3 schematically represents a cross-sectional perspective view which is similar to FIG. 2, but which additionally illustrates the flow of air and vapor through the aerosol provision system, in accordance with certain embodiments of the disclosure.
Figure 4A:
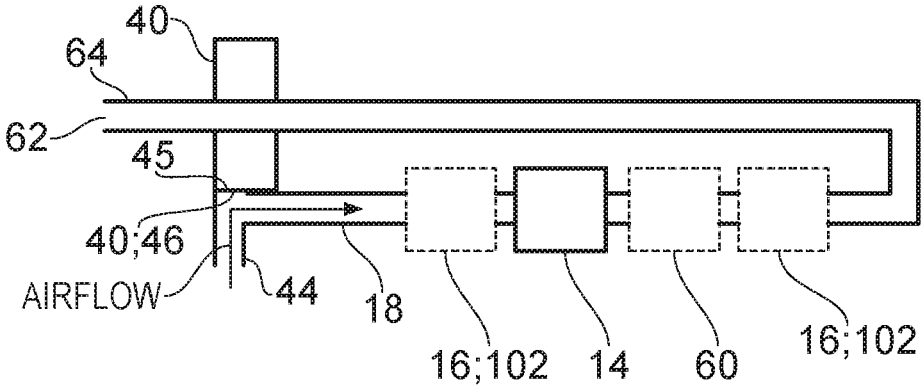
FIG. 4A schematically represents an aerosol provision system related to those from FIGS. 1-3, and which is in a first configuration in which an opening from the aerosol provision system is covered, wherein the opening is configured to selectively inhibit the delivery of vaporized aerosolizable material in the aerosol provision system, in accordance with certain embodiments of the disclosure.
Figure 4B:
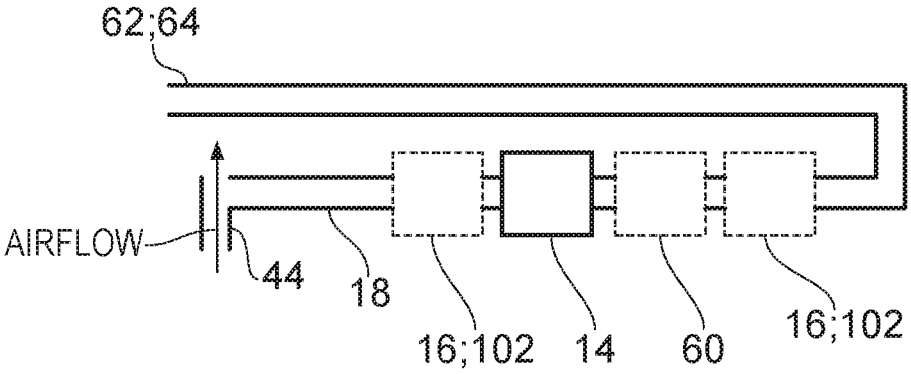
FIG. 4B schematically represents the aerosol provision system from FIG. 4A, but which is in a second configuration in which the opening from the aerosol provision system is uncovered, in accordance with certain embodiments of the disclosure.
Figure 5A:
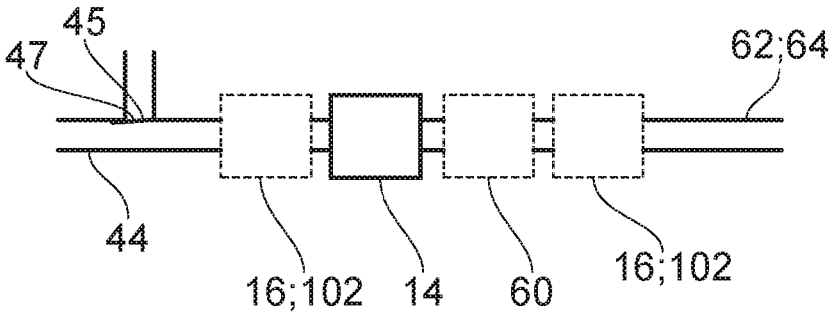
FIG. 5A schematically represents an aerosol provision system related to those from FIGS. 1-3, and which is in a first configuration in which an opening from the aerosol provision system is covered, wherein the opening is configured to selectively inhibit the delivery of vaporized aerosolizable material in the aerosol provision system, in accordance with certain embodiments of the disclosure.
Figure 5B:
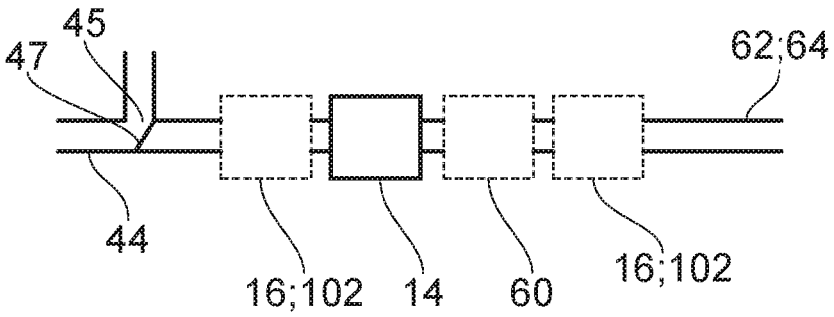
FIG. 5B schematically represents the aerosol provision system from FIG. 5A, but which is in a second configuration in which the opening from the aerosol provision system is uncovered, in accordance with certain embodiments of the disclosure.

From the forgoing therefore, and with reference to FIGS. 1-3, in accordance with some embodiments provided herein is an aerosol provision system 1 which may in some embodiments be provided as a body 10 which can releasably accommodate, and/or be releasably attached to, a consumable part 100. The aerosol provision system 1 comprises a first reservoir 12 for containing an aerosolizable material for vaporizing, and a vaporizer 14 for vaporizing the aerosolizable material from the first reservoir 12. The aerosol provision system 1 also defines a cavity 16 which is configured to receive the consumable part 100.

With respect to the consumable part 100, this may comprise the flavoring material, which may be located in a second reservoir 102.

In accordance with some embodiments, the vaporizer 14 may be tubular and surround the cavity 16, which may provide for a more efficient spacing/layout of the vaporizer 14 with respect to the cavity 16 in such a way that the aerosol provision system 1 can be smaller, and more compact.

Also in accordance with some embodiments, such as the embodiments shown in FIGS. 1-3, the aerosol provision system 1 may comprise a first channel 18 between the vaporizer 14 and the cavity 16, wherein the vaporizer 14 is configured to impart vaporized aerosolizable material into the first channel 18. In this way, and as will be described, once vaporized aerosolizable material is imparted to the first channel 18 by the vaporizer 14, the vaporized aerosolizable material may then pass through the first channel 18, into the cavity 16 and through any consumable part 100 located therein (including any second reservoir 102 thereof, if present), and finally out of the consumable part 100 through to the user's mouth, for inhalation of the vaporized aerosolizable material by the user.

In accordance with some of the above embodiments, the first channel 18 (where present) may be parallel to the cavity 16, as shown in the embodiments from FIGS. 1-3. Additionally/alternatively, in accordance with some embodiments, during use of the aerosol provision system 1, air may be configured to flow in a first direction A1 along the first channel 18, and vaporized aerosolizable material from the vaporizer 14 configured to flow in a second direction A2 through the consumable part 100 in the cavity (or, put differently, principally flow in a second direction A2 through the second reservoir 102) wherein the second direction A2 is opposite to the first direction A1. In such embodiments, the first direction A1 may be parallel to a length of the first channel 18, which extends between a first end 18A of the first channel 18 and a second end 18B of the first channel (which may be opposite the first end 18A of the first channel 18). Equally, in accordance with some embodiments, the second direction A2 may be parallel to a length of the cavity 16, which extends between a first end 16A of the cavity 16 (which may be a closed first end 16A in some embodiments) and a second end 16B of the cavity 16 (which may be opposite the first end 16A of the cavity 16, and which in some embodiments may be an open second end 16B). Where the second reservoir 102 is present, in such embodiments, the second direction A2 may in some embodiments thereof be parallel to a length of the second reservoir 102, which extends between a first end 102A of the second reservoir 102 and a second end 102B of the second reservoir 102 (which may be opposite the first end 102A of the second reservoir 102).

In embodiments where the second direction A2 is opposite to the first direction A1, this may allow for a more compact aerosol provision system 1, such as those shown in the embodiments from FIGS. 1-3, As well, the change in direction from the first direction A1 to the second direction A2 may increase the turbidity of the air passing from the first channel 18 into the cavity 16; the consumable part 100; and/or the second reservoir 102, which may assist with a better passage of vapor through such features along the second direction A2.

Returning to the features of the first channel 18, in accordance with some embodiments, any provided first channel 18 may be tubular, and/or may be located outside of the cavity 16. In such embodiments thereof, the first channel 18 may then extend from the previously described first end 18A and the second end 18B (which may be opposite the first end 18A) for the first channel 18. In accordance with some embodiments, the first channel 18 may be located between the vaporizer 14 and any provided second reservoir 102, and/or may be located between the first reservoir 12 and any provided second reservoir 102, as shown in the embodiments from the Figures.

With respect to the vaporizer 14, as noted previously the vaporizer 14 may, or may not comprise a heater/heating element to form the vaporized aerosolized material. Though in embodiments where the vaporizer 14 comprises a heating element 22, in accordance with some embodiments thereof, the vaporizer 14 may further comprise an aerosolizable material transport element 20 (also called a wick) for delivering aerosolizable material from the first reservoir 12 to the heating element 22. In respect of such embodiments, it will be appreciated that a number of different combinations of aerosolizable material transport element 20 and/or heating element 22 might be employed. For instance, in accordance with some embodiments, the heating element 22 may comprise a conductive material located on an external surface of the aerosolizable material transport element 20, such as a surface 23 which is exposed to the first channel 18. Such conductive material may appreciably take any required shape on the surface of the aerosolizable material transport element 20, e.g. a spiral pattern; a raster pattern; or a zig-zag pattern such to allow the heating element 22 to efficiently vaporize the aerosolizable material in the aerosolizable material transport element 20. As will be appreciated, the heating element 22 (or the vaporizer 14 in general, where a heating element 22 is not employed) may be connected to a power source 24 from the aerosol provision system 1, which in some embodiments may be a battery. In embodiments where the aerosol provision system 1 comprises the body 10 which can releasably accommodate, and/or be releasably attached to, the consumable part 100, in some embodiments thereof the power source 24 may be located in the body 10. Electrical power from the power source 24 may be supplied via a wired connection 26 to the vaporizer 14, and/or appreciably may be delivered to the vaporizer 14 in some embodiments wirelessly or through a non-contact power transmission system between the power source 24 and the vaporizer.

As to the structure and composition of any provided aerosolizable material transport element 20 (wick), it will be appreciated that the aerosolizable material transport element 20 may be anything which can appropriately draw the aerosolizable material to a position where it can be vaporized by the heating element 22 during use of the aerosol provision system 1. In that respect therefore, in accordance with some embodiments, the aerosolizable material transport element 20 may comprise a porous material, and/or a fibrous material or a solid material. In some embodiments, the aerosolizable material transport element 20 may be made of cotton, or could be made of a ceramic material. Thus appreciating the foregoing, and at a general level, it will be appreciated the specific structure and composition of the aerosolizable material transport element 20 may be varied to best cater for any intended application of the aerosol provision system 1.

For delivering air into the aerosol provision system 1, the aerosol provision system 1 may comprise at least one air inlet 28. In some embodiments, a plurality of air inlets 28 may be provided, and in some very particular embodiments (such as those shown in FIGS. 1-3), the plurality of air inlets 28 may be disposed on side surfaces 30 of the aerosol provision system 1 or body 10, such as in some particular embodiment on side surfaces 30 which extend between a first end 32 of the body 10 and a second end 34 of the body 10 which is opposite the first end 32 of the body 10. By providing more than one air inlet 28, this may conveniently allow for continued operation of the aerosol provision system 1, even if one of the air inlets 28 becomes blocked or inoperable during use. To better ensure an even distribution of air flow through the aerosol provision system 1, in accordance with some embodiments, there may be provided a pair of air inlets 28 located on opposing side surfaces 30 from the aerosol provision system 1 (or body 10), such as in the embodiments shown in FIGS. 1-3.

To better prevent dirt or fluid from entering each air inlet 28 when the aerosol provision system 1 is not in use, in accordance with some embodiments, there may be provided a closing member 36 which is moveable between a first position in which the at least one air inlet 28 is open and a second position in which the at least one air inlet 28 is blocked. Such a closing member 36 may comprise a variety of different forms, such as a valve for each air inlet; a rotatable sleeve which is rotatable between the first position and the second position; and/or a moveable latch. In a particular embodiment, such as those shown in FIGS. 1-3, the closing member may comprise a cap 38 which is moveable or rotatable between the first position and the second position. In accordance with some embodiments, the closing member 36 may be configured to make an audible noise (such as a 'click') when the closing member 36 reaches the first position and/or the second position. Such an audible noise may, for instance, be created by the closing member 36 engaging a slot, or ratchet, at each of the first position and the second position. Said slot or ratchet might then be disengaged by the user then applying force to move the closing member 36 from said first or second position towards the other of the first and second positions. With the audible noise, the user will then better know when the closing member 36 is properly located at either the first position and/or the second position.

In accordance with some embodiments, the aerosol provision system 1 (or body 10) may be provided with a retaining member 40, for gripping a consumable part 100 received in the aerosol provision system 1 (or body 10). Such a retaining member 40, which in accordance with some embodiments may be a retaining portion 40 and/or a retaining plug 40, is illustrated in the embodiments from the FIGS. 1-3 at least. The retaining member 40 may surround any provided cavity 16, and may in some particular embodiments surround any second open end 16B of the cavity 16. Thus in embodiments where the retaining member 40 is provided, the retaining member 40 may provide a frictional holding force on the consumable part 100 received in the aerosol provision system 1 (or body 10). Put differently, the retaining member 40 in some embodiments may be configured to releasably accommodate the consumable part 100 received in the aerosol provision system 1 (or body 10). In this way therefore, the retaining member 40 better prevents any consumable part 100 from being accidentally disengaged from, and/or from sliding out of, the aerosol provision system 1 (or body 10) during use, and may better orientate the consumable part 100 in the aerosol provision system 1 (or body 10/cavity 16) during use.

Returning to the at least one air inlet 28, in accordance with some embodiments the aerosol provision system 1 may comprise an initial air channel 44 between the at least one air inlet 28 and the first channel 18. The initial air channel 44 may in be inclined with respect to the first channel 18 and the at least one air inlet 28 for changing the direction of air flowing from the at least one air inlet 28 into the first channel 18. In this way, the initial air channel 44 advantageously provides for a channel which may better guide and prepare the air for entry into the first channel 18. In this way, the presence of the air channel 44 may provide for a more effective flow of air through the first channel 18. As shown in the embodiments from the FIGS. 1-3, any provided initial air channel 44 may in some embodiments be located next to, and feed air into, the first end 18A of the first channel 18.

In embodiments where the retaining member 40 is also employed, in accordance with some embodiments thereof, a surface of the retaining member 40 may define a first surface 46 of the initial air channel 44. In this way, where the retaining member 40 (which may act to better grip and/or orientate the consumable part 100) is removed, this may render the aerosol provision system 1 inoperable, due to air then being able to escape the system through the exposed area/opening 45 where the first surface 46 would otherwise be. In other words, a surface of the retaining member 40 defining the first surface 46 of the initial air channel 44 may act as a safety feature for the aerosol provision system 1. As to the exact shape of any such surface of the retaining member 40 in such embodiments, it will be appreciated that this shape will depend on the relative location of the retaining member 40 to the initial air channel 44. However, in accordance with some embodiments, the retaining member 40 may be annular, and/or the surface of the retaining member may be a conical surface. With this in mind, and for the sake of completeness, it is envisaged in some embodiments that the surface of the retaining member 40 may equally define a surface 46 from another portion of the air channel between the at least one air inlet 28 and the vaporizer 14, to similarly achieve the above noted safety feature.

Returning to aspects of the first channel 18, as noted previously, the first channel 18 may comprise the first end 18A and the second end 18B (which may be opposite the first end 18A), and/or in some embodiments may be cylindrical. In this way, and where the retaining member is employed 40, in some embodiments thereof, the first end 18A of the first channel 18 may be located between the retaining member 40 and the second end 18B of the first channel 18. In this way, and in some embodiments, the first end 18A of the first channel 18 and any open second end 16B of the cavity 16 (which may receive the consumable part 100) may be located on the same side of the second end 18B of the first channel 18. In these embodiments therefore, these may assist with implementing any previously described change in the direction of the air passing through the first channel 18 (e.g. in the direction A1) versus the flow of vapor passing through the cavity 16 and/or the second reservoir 102 (e.g. in the direction A2).

Turning to the first reservoir 12, for better reducing any leakage of aerosolizable material from the first reservoir 12, in accordance with some embodiments the first reservoir 12 may comprise a sealing member 48 for sealing a portion of the first reservoir 12. Conveniently, in some particular embodiments, the sealing member 48 may additionally comprise a surface which defines a second surface 52 of the initial air channel 44. In this way, where the sealing member 48 is removed and/or sufficiently worn out, a leakage path in the initial air channel 44 (or more generally a leakage path in the air path between the at least one air inlet 28 and the vaporizer 14) may be introduced. to effectively render the aerosol provision system 1 inoperable, due to air then being able to escape the system through the exposed area where the second surface 52 would otherwise be. In other words, a surface of the sealing member 48 defining the second surface 52 of the initial air channel 44 may act as a safety feature for the aerosol provision system 1. Again, and for the sake of completeness, it is envisaged in some embodiments that the surface of the sealing member 48 may equally define a surface 52 from another portion of the air channel between the at least one air inlet 28 and the vaporizer 14, to similarly achieve the above noted safety feature.

As to the shape of the first reservoir 12, it will be appreciated that it may take any required shape to supply aerosolizable material to the vaporizer 14 (and/or the aerosolizable material transport element 20, where present). In some embodiments however, such as those shown in the FIGS. 1-3, the first reservoir 12 may be cylindrical, and potentially may extend between a first end and second end. In some particular embodiments thereof where the sealing member 48 is additionally employed, the sealing member 48 may in some cases define at least one of the first end and the second end of the first reservoir 12, as shown in the embodiment of the FIGS. 1-3. Staying with the first reservoir 12, in accordance with some embodiments, the aerosol provision system 1 and/or the first reservoir 12 may comprise a viewing means 56 for allowing a user to observe a quantity or level of aerosolizable material inside the first reservoir 12. Conceivably, such a viewing means 56 may comprise a transparent or translucent portion 58 from the first reservoir 12, or may comprise a window for viewing inside the first reservoir 12. In this way, the viewing means 56 thus allows the user to make a visual determination as to when aerosolizable material in the first reservoir 12 is low/depleted, or may allow the user to identity any malfunctions that might be otherwise viewable inside the first reservoir 12.

Turning to the cavity 16, as noted previously the cavity 16 may in some embodiments extend between a first end 16A of the cavity 16 (which may be a closed first end 16A in some embodiments) and a second end 16B of the cavity 16 (which may be opposite the first end 16A of the cavity 16, and which in some embodiments may be an open second end 16B). The cavity 16 in some embodiments may be cylindrical, such as in embodiments where any provided consumable part 100 is cylindrical and/or where the consumable part 100 resembles the shape of a cigarette. In accordance with some embodiments, the first channel 18 and the cavity 16, and/or the first channel 18 and any provided second reservoir 102, may be separated by at least one partitioning member, such as in some particular embodiments a wall which may be tubular. For the sake of completeness however, it will be appreciated that a function of the at least one partitioning member may be to appropriately separate any vapor passing through any provided second reservoir 102/consumable part 100 from mixing with air flowing through the first channel 18. Accordingly, in some embodiments, an appropriate partition may be achieved by an outer wall of the consumable part 100 acting to suitably separate air in the first channel 18 from vapor passing through the consumable part 100 and/or any second reservoir 102 located therein without the need for any further/separate partitioning member from the aerosol provision system 1 and/or body 10 itself.

Moving to any provided second reservoir 102 from the aerosol provision system 1, for the sake of completeness, the second reservoir 102 could be located in a consumable part 100 which may be releasably accommodated in the aerosol provision system 1, or may be provided in an aerosol provision system 1 where no such consumable part 100 is employed. In such latter embodiments, the second reservoir 102 may for instance be located in (or integrated in) the cavity 16 in a way which inhibits vapor which passes through the second reservoir 102, towards an outlet for inhalation by the user, from mixing with the air passing through the first channel 18. Separation of the air flow from the first channel 18 and the vapor flow through the second reservoir 102 may, in accordance with some embodiments thereof, be achieved by the presence of the at least one partitioning member as described above.

As recited previously, any provided second reservoir 102 from the aerosol provision system 1 may comprise a flavoring material(s), and is configured to receive vaporized aerosolizable material from the vaporizer 14. The flavoring material(s) may comprise any of the previously described flavoring materials, such as (but not limited to) tobacco and/or nicotine. Where the vaporizer 14 comprises the heating element 22, the flavoring material from the second reservoir 102 may be configured to be at least partially heated from vaporized aerosolizable material from the vaporizer 14 which flows through the second reservoir 102. In this way, the heat from the vaporized aerosolizable material may better cause the flavoring material to be imparted into the vaporized aerosolizable material to form the flavored vapor which is imparted to the user. In this respect, in some particular embodiments, the flavoring material from the second reservoir 102 may be additionally configured to be at least partially heated by the heating element 22 from the vaporizer 14, as shown in the embodiments from the Figures. In this way, heat from the heating element 22 may be transmitted to the second reservoir 102 to provide an additional source of heating to the flavoring material in the second reservoir 102. Such additional heating may be particularly effective when the aerosol provision system 1 is used after a period of sustained inactivity, in so far as the heat from the heating element 22 may then provide an initial amount of heat to the flavoring material in the second reservoir 102 prior to any vaporized aerosolizable material reaching the (otherwise cold) flavoring material in the second reservoir 102. In this way therefore, having heat from the heating element 22 transmitted to the second reservoir 102 to provide an additional source of heating to the flavoring material in the second reservoir 102 may provide a more consistent form of heat to the second reservoir 102, and may allow for a boost of preheat to the second reservoir 102 which may be advantageous in situations when the aerosol provision system 1 has not been used for a period of sustained inactivity.

Conveniently as well, in accordance with some of these embodiments where heat is supplied from the heating element 22, the need for a second heating element, which is separate from the heating element 22, for heating the second reservoir 102 may be potentially removed. Put differently, in accordance with some of these potential embodiments, the aerosol provision system 1 may be provided with only one heating element 22, and/or may be configured such that the second reservoir 102 does not comprise a heating element (for heating the second reservoir 102) which is separate from the heating element 22. Phrased yet another way, in accordance with some of these embodiments, the flavoring material from the second reservoir may be configured to be exclusively heated by both the heat from the vaporized aerosolizable material from the vaporizer 14 which flows through the second reservoir, and by the heat from the heating element 22 from the vaporizer 14.

Mindful of the above disclosure, it will be appreciated that aspects of the aerosol provision system 1 herein described may in certain embodiments be configured to act as a safety feature for inhibiting the delivery of vaporized aerosolizable material in certain configurations of the aerosol provision system 1, such as when the consumable part 100 or the retaining member 40 is not accommodated by the body 10.

Appreciating this disclosure, and turning to the disclosure from FIGS. 4A-6B therefore, it is envisaged that the present disclosure may also effectively provide for an aerosol provision system 1 comprising a vaporizer 14 for vaporizing aerosolizable material, and an air inlet channel 44 for delivering air to the vaporizer 14, wherein the air inlet channel 44 comprises an opening 45 which is configured to be covered when the aerosol provision system 1 is in a first configuration, and which is configured to be uncovered when the aerosol provision system 1 is in a second configuration, wherein the opening 45 is configured to allow air to bypass the vaporizer 14 when the opening 45 is uncovered, by bypassing out from the air inlet channel 44 through the opening 45, for inhibiting the delivery of vaporized aerosolizable material when the aerosol provision system 1 is in the second configuration.

It is envisaged that in any such embodiment where the opening 45 is employed to effectively control or inhibit the delivery of vaporized aerosolizable material, that this opening 45 need not necessarily be used in the context of an aerosol provision system 1 which expressly comprises a separate body 10 and consumable part 100.

As noted above, the provision of such an opening 45 in the aerosol provision system is best illustrated with reference to the embodiments of aerosol provision system shown in FIGS. 4A-6B.

In the above respect for instance, the covering of the opening 45 in accordance with some embodiments may be configured to be controlled or actuated in response to a command from a user. For instance, in a particular embodiment, the aerosol provision system 1 may comprise a cover member 47 for covering the opening in the first configuration, and not covering the opening in the second configuration. Such an embodiment is shown, for instance, with reference to the disclosure of FIGS. 5A-5B. In this way, and in accordance with some embodiments, the cover member 47 may be moveable to alter the aerosol provision system 1 between the first configuration and the second configuration. In accordance with some particular embodiments, the cover member 47 may be configured to be moved by the user, and/or be configured to be moved in response to an electrical signal (e.g. in response to a user pressing a switch or button from the aerosol provision system 1, or potentially a switch or button from the body 10 from the aerosol provision system 1—where such a body 10 is employed).

With such embodiments therefore, it may be seen that cover member 47 may act as a safety feature which inhibits the delivery of vaporized aerosolizable material when the aerosol provision system 1 is in the second configuration (where the cover member 47 does not cover the opening 45).

Equally however, in accordance with some embodiments where the aerosol provision system 1 comprises the consumable part 100 and the body 10, the cover member 47 may be supplemented or replaced with a portion of the consumable part 100. In this way, in accordance with some embodiments, the opening 45 may be configured to be covered by the consumable part 100 when the aerosol provision system 1 is in the first configuration. Equally, in accordance with some embodiments, such as those described previously with reference to FIGS. 1-3, the opening 45 may be configured to be covered by the retaining member 40 when the aerosol provision system 1 is in the first configuration (in embodiments where this retaining member 40 is employed). Such a latter embodiment employing the retaining member 40 is illustrated with reference to the embodiment from FIGS. 4A-4B. For the sake of completeness however, and with reference to the embodiments of FIGS. 4A-4B, it will be appreciated that any portion of the consumable part 100 might instead be configured to cover the opening 45 without the need for the retaining member 40 necessarily.

Mindful of the above therefore, it can be seen that the provision of the opening 45, or indeed more than one opening 45 in some embodiments, may allow for the inhibiting the delivery of vaporized aerosolizable material when the aerosol provision system is in the second configuration-through the air bypassing the vaporizer 14. Tying in with this, it will be appreciated that this opening(s) 45 in accordance with some embodiments may be similarly employed to also allow air to bypass other components of the aerosol provision system 1. These other components which may be optionally bypassed are shown in dotted lines with respect to the embodiments illustrated in FIGS. 4A-5B. In this respect for instance, and in accordance with some embodiments, where the aerosol provision system 1 comprises the reservoir 102 for containing flavoring material (which might be located upstream or downstream of the vaporizer 14), the air inlet channel 44 may be configured such that air flowing through the opening 45 bypasses the reservoir 102. Additionally/alternatively, in accordance with some embodiments where the aerosol provision system 1 comprises a cavity 16 configured to receive a flavoring material (again which might be located upstream or downstream of the vaporizer 14), the air inlet channel 44 may be configured such that air flowing through the opening 45 bypasses the cavity 16. In these embodiments therefore, the presence of the opening 45 may allow for the flavoring material to be better preserved/unused when the aerosol provision system 1 is in the second configuration.

In respect of any air which might bypass out from the air inlet channel 44 through the opening 45, it will be appreciated that the aerosol provision system 1 may be configured to deliver the air to a location outside the aerosol provision system 1 directly in accordance with some embodiments, such as in the embodiments shown in FIGS. 4A-5B. In this way, when air is passed or forced into the aerosol provision system 1 through the air inlet channel 44 when the aerosol provision system 1 is in the second configuration, the air may then pass straight through the opening 45, such to bypass the vaporizer 14 from the aerosol provision system 1, and then out of the aerosol provision system 1.

Figure 6A:
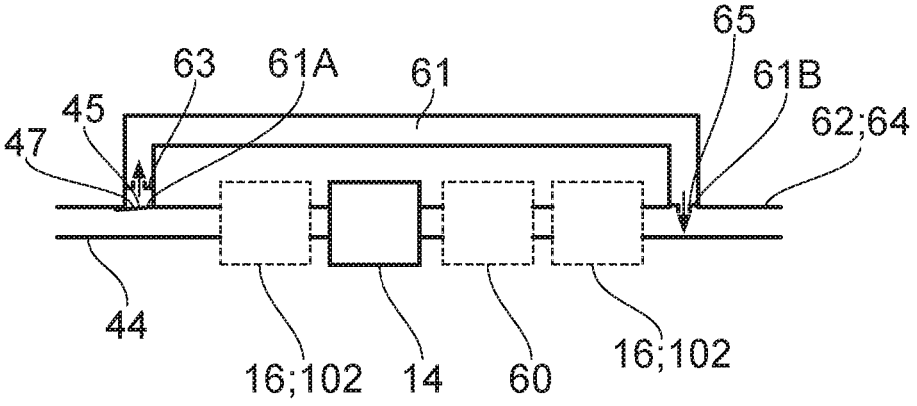
FIG. 6A schematically represents an aerosol provision system related to those from FIGS. 1-3, and which is in a first configuration in which an opening from the aerosol provision system is covered, wherein the opening is configured to selectively inhibit the delivery of vaporized aerosolizable material in the aerosol provision system, in accordance with certain embodiments of the disclosure.
Figure 6B:
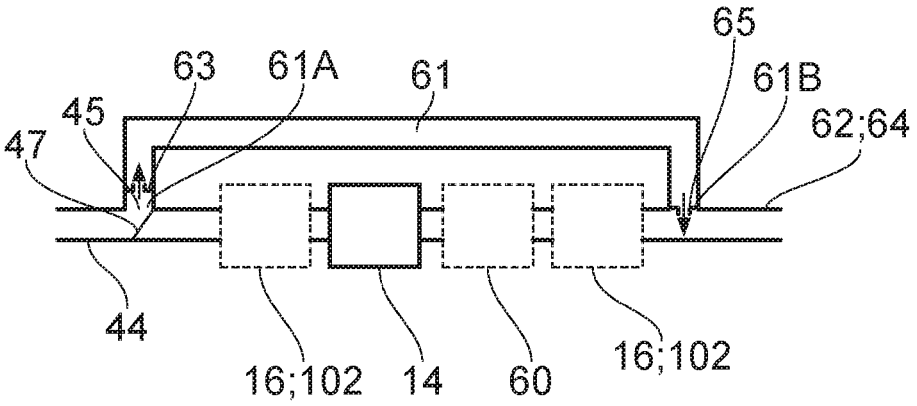
FIG. 6B schematically represents the aerosol provision system from FIG. 6A, but which is in a second configuration in which the opening from the aerosol provision system is uncovered, in accordance with certain embodiments of the disclosure.

Equally however, in accordance with some embodiments, such as that shown in FIGS. 6A-6B, in respect of any air which might bypass out from the air inlet channel 44 through the opening 45, the aerosol provision system 1 may be configured to deliver the air passing through the opening 45 to a location downstream of the vaporizer 14 in a way such that the air passing through the opening 45 bypasses the vaporizer 14. In accordance with such embodiments therefore, the air which bypasses out from the air inlet channel 44 through the opening 45 may be configured to be delivered to a location which is downstream of the vaporizer 14, and upstream of any provided outlet 62 or mouthpiece 64 from the aerosol provision system 1. Put differently, in accordance with such embodiments, the aerosol provision system 1 may be provided with a bypass passage 61 comprising a first end 61A for receiving air bypassing out from the air inlet channel 44 through the opening 45, and a second end 61B for delivering this air to a location downstream of the vaporizer 14 in a way such that the air passing through the bypass passage 61 bypasses the vaporizer 14. Appreciably as well, in accordance with some particular embodiments where the bypass passage 61 is employed, the second end 61B of the bypass passage 61 may be configured for delivering the air which bypasses out from the air inlet channel 44 through the opening 45 to a location downstream of any employed cavity 16 or reservoir 102 from the aerosol provision system 1, and in a way such that this air bypasses the employed cavity 16 or reservoir 102. Such an embodiment of aerosol provision system 1 is illustrated with reference to FIGS. 6A and 6B.

In respect of the functionality of the opening 45 to better allow for air to bypass out from the air inlet channel 44 through the opening 45 when the aerosol provision system 1 is in the second configuration, in accordance with some embodiments, the aerosol provision system 1 may further comprise a one-way valve 63 for inhibiting air from passing through the opening 45 into the air inlet channel 44. As to the location of any such provided one-way valve, it will be appreciated that the opening 45 in accordance with some embodiments may comprise the one-way valve, or the one-way valve 63 may be located downstream of the opening 45, such as in the bypass passage 61 (where such a bypass passage 61 is employed). Equally, where the bypass passage 61 is employed, such as in accordance with the embodiment illustrated in FIGS. 6A and 6B, the aerosol provision system 1 may comprise a second one-way valve 65 for inhibiting air downstream of the vaporizer 14 from passing back into the bypass passage 61. Appreciably any employed one-way valve 63; 65 might comprise any form of suitable one-way valve, such as a duckbill valve or a reed valve in accordance with some particular embodiments.

With respect to any relative spacing of the opening(s) 45 with respect to other components of the aerosol provision system 1, in accordance with some embodiments where the aerosol provision system 1 comprises a mouthpiece 64 defining an outlet 62 for vaporized aerosolizable material, in the first configuration of the aerosol provision system the opening 45 may be located closer to the mouthpiece 64 than the vaporizer 14 is located to the mouthpiece 64. In this way, this may allow for a more compact sized aerosol provision system 1.

Irrespective of whether the opening 45 is employed however, in accordance with some embodiments, to further help control the delivery of vaporized aerosolizable material in the aerosol provision system 1, the aerosol provision system 1 may further comprise a puff sensor 60 configured to permit the operation of the vaporizer 14 in response to detecting a puff of air in the aerosol provision system 1. As to the location of any such puff sensor 60 in the aerosol provision system 1, it will be appreciated that this may be located in a number of different locations in the aerosol provision system 1. In this respect for instance, in accordance with some particular embodiments, the puff sensor 60 may be located upstream of any provided outlet 62 or mouthpiece 64, or located upstream or downstream of the vaporizer 14, or upstream or downstream of any provided cavity 16 or second reservoir 102. Purely by way of illustration, and in accordance with the embodiments disclosed in the Figures (such as in FIGS. 1-3), a puff sensor 60 is shown downstream of the vaporizer 14 and upstream of the second reservoir 102/cavity 16.

Where a puff sensor 60 is employed, in accordance with some embodiments, the puff sensor 60 may be employed together with the opening 45 to yet further help control the delivery of vaporized aerosolizable material in the aerosol provision system 1, as shown for instance with respect to the embodiments from FIGS. 4A-6B. In this respect for instance, and in accordance with some embodiments, the air inlet channel 44 may be configured such that air flowing through the opening 45 bypasses the puff sensor 60. Put differently, the puff sensor 60 (and the vaporizer 14) may be located downstream of the opening 45. In this way, when the opening 45 is uncovered when the aerosol provision system 1 is in the second configuration, the air may bypass the puff sensor 60 to better ensure that the vaporizer 14 is not operated in this second configuration through the puff sensor 60 not being able to detect the puff of air in the aerosol provision system 1 (which instead has bypassed through the opening 45).

Appreciating the foregoing therefore, it can be seen that herein described is also a method for controlling the delivery of vaporized aerosolizable material in an aerosol provision system 1 comprising a vaporizer 14 and an air inlet channel 44, wherein the method comprises moving the aerosol provision system 1 between a first configuration, in which an opening 45 of the air inlet channel 44 is covered for allowing air passing through the air inlet channel 44 to reach the vaporizer 14, and a second configuration in which the opening 45 is uncovered to allow air to bypass the vaporizer 14 by bypassing out from the air inlet channel 44 through the opening 45.

With respect to such methods, it will be appreciated that such methods may comprise moving the aerosol provision system from the second configuration (in which the opening 45 is uncovered) to the first configuration (in which the opening 45 is covered), or similarly may comprise moving the aerosol provision system 1 from the first configuration to the second configuration. Equally, where the method comprises moving the aerosol provision system 1 from the second configuration to the first configuration, this may be achieved by accommodating the consumable part 100 in the body 10 (where such a consumable part/body arrangement is employed).

With respect to such herein described methods as well, in accordance with some embodiments, the method may further comprise operating the aerosol provision system 1 in the first configuration for allowing the vaporizer 14 to receive air from the air inlet channel 45. Appreciably, in some embodiments, such operation of the aerosol provision system 1 may be following the aerosol provision system 1 being moved from the second configuration to the first configuration.

In the above respect therefore, and in accordance with some embodiments provided herein, there may be provided an aerosol provision system 1 comprising: the first reservoir 12 for containing an aerosolizable material for vaporizing; the vaporizer 14 for vaporizing the aerosolizable material from the first reservoir 12, wherein the vaporizer 14 comprises a heating element 22; the first channel 18 for receiving aerosolizable from the vaporizer 14; the second reservoir 102 comprising a flavoring material, wherein the second reservoir 102 is configured to receive vaporized aerosolizable material from the vaporizer 14; wherein flavoring material from the second reservoir 102 is configured to be at least partially heated from vaporized aerosolizable material from the vaporizer 14 which flows through the second reservoir 102, and is configured to be at least partially heated by the heating element 22 from the vaporizer 14.

From the foregoing, described herein are a number of different improvements pertaining to a number of a different aspects of aerosol provision systems. In that respect therefore, and at least, there has been described an aerosol provision system comprising:

- a first reservoir for containing an aerosolizable material for vaporizing;
- a vaporizer for vaporizing the aerosolizable material from the first reservoir, wherein the vaporizer is tubular and surrounds a cavity from the aerosol provision system;
- wherein the cavity is configured to receive a consumable part comprising a flavoring material.

There has also been described an aerosol provision system comprising:

- a first reservoir for containing an aerosolizable material for vaporizing;
- a vaporizer for vaporizing the aerosolizable material from the first reservoir, wherein the vaporizer is tubular and surrounds a cavity from the aerosol provision system;
- wherein the cavity accommodates a second reservoir comprising a flavoring material, wherein the second reservoir is configured to receive vaporized aerosolizable material from the vaporizer.

There has also been described an aerosol provision system comprising:

- a first, cylindrical, reservoir for containing an aerosolizable material for vaporizing;
- a vaporizer for vaporizing the aerosolizable material from the first reservoir;
- a first channel for receiving vaporized aerosolizable material from the vaporizer;
- a second, cylindrical, reservoir comprising a flavoring material, wherein the second reservoir is configured to receive vaporized aerosolizable material from the first channel;
- wherein air is configured to flow in a first direction along the first channel, and vaporized aerosolizable material from the vaporizer is configured to flow in a second direction through the second reservoir, wherein the second direction is opposite to the first direction.

There has also been described an aerosol provision system comprising:

- at least one air inlet for delivering air into the aerosol provision system;
- a first reservoir for containing an aerosolizable material for vaporizing;
- a vaporizer for vaporizing the aerosolizable material from the first reservoir;
- a first channel for receiving vaporized aerosolizable material from the vaporizer, and for receiving air from the at least one air inlet;
- an initial air channel between the at least one air inlet and the first channel; and
- a retaining member, for gripping a consumable part receivable in the aerosol provision system, wherein a surface of the retaining member defines a first surface of the initial air channel.

There has also been described an aerosol provision system comprising:

- a first reservoir for containing an aerosolizable material for vaporizing; and
- a retaining member, for gripping a consumable part receivable in the aerosol provision system;
- wherein the aerosol provision system is configured to inhibit the formation of a vapor in at least one of the aerosol provision system and the consumable part, using aerosolizable material from the first reservoir, when the retaining member is removed.

There has also been described an aerosol provision system comprising:

- a first reservoir for containing an aerosolizable material for vaporizing;
- a vaporizer for vaporizing the aerosolizable material from the first reservoir, wherein the vaporizer comprises a heating element, and wherein the vaporizer is tubular;

a second reservoir comprising a flavoring material, wherein the second reservoir is configured to receive vaporized aerosolizable material from the vaporizer;

wherein flavoring material from the second reservoir is configured to be at least partially heated from vaporized aerosolizable material from the vaporizer which flows through the second reservoir, and is configured to be at least partially heated by the heating element from the vaporizer.

There has also been described an aerosol provision system comprising a vaporizer for vaporizing aerosolizable material, and an air inlet channel for delivering air to the vaporizer, wherein the air inlet channel comprises an opening which is configured to be covered when the aerosol provision system is in a first configuration, and which is configured to be uncovered when the aerosol provision system is in a second configuration, wherein the opening is configured to allow air to bypass the vaporizer when the opening is uncovered, by bypassing out from the air inlet channel through the opening, for inhibiting the delivery of vaporized aerosolizable material when the aerosol provision system is in the second configuration.

There has also been described a method for controlling the delivery of vaporized aerosolizable material in an aerosol provision system comprising a vaporizer and an air inlet channel, wherein the method comprises:

moving the aerosol provision system between a first configuration, in which an opening of the air inlet channel is covered for allowing air passing through the air inlet channel to reach the vaporizer, and a second configuration in which the opening is uncovered to allow air to bypass the vaporizer by bypassing out from the air inlet channel through the opening.

There has also been described an aerosol provision system 1 comprising a vaporizer 14 for vaporizing aerosolizable material, and an air inlet channel 44 for delivering air to the vaporizer 14, wherein the air inlet channel 44 comprises an opening 45 which is configured to be covered when the aerosol provision system 1 is in a first configuration, and which is configured to be uncovered when the aerosol provision system 1 is in a second configuration, wherein the opening 45 is configured to allow air to bypass the vaporizer 14 when the opening 45 is uncovered, by bypassing out from the air inlet channel 44 through the opening 45, for inhibiting the delivery of vaporized aerosolizable material when the aerosol provision system 1 is in the second configuration.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

For instance, although the present disclosure has been described with reference to a "liquid" or "fluid" in the first reservoir, it will be appreciated that this liquid or fluid may be replaced with any aerosolizable material. Equally, where an aerosolizable material is used, it will be appreciated that in some embodiments this aerosolizable material may comprise a liquid or fluid.

With respect to the vaporizer 14, although the vaporizer 14 has been described in some embodiments as comprising a heater/heating element 22, it will be appreciated that in some other embodiments the vaporizer 14 may be capable of generating a vapor/aerosol from the aerosolizable material without applying heat thereto, for example via one or more of vibrational, mechanical, pressurisation or electrostatic means as described previously.

Concerning any provided flavoring material as well, for the sake of completeness it is to be noted that any provided flavoring material need not necessarily be heated to release its flavoring to the vaporized aerosolizable material. In that respect therefore, it is not necessarily the case that any vaporizer 14 in these instances must necessarily require the heating element 22.

Finally as well, whilst a number of the features herein described have been described with reference to embodiments of aerosol provision system 1 which are provided as part of a body 10 which can releasably accommodate, and/or be releasably attached to, a consumable part 100, it will be appreciated that in some embodiments, any of the herein described features from the consumable part 100 and/or the body 10 may be integrated into an aerosol provision system 1 which does not comprise such a consumable part/body 100 configuration.

The invention claimed is:

1. An aerosol provision system comprising a vaporizer for vaporizing aersosolizable material, and an air inlet channel for delivering air to the vaporizer, wherein the air inlet channel comprises an opening which is configured to be covered when the aerosol provision system is in a first configuration, and which is configured to be uncovered when the aerosol provision system is in a second configuration, wherein the opening is configured to allow air to bypass the vaporizer when the opening is uncovered, by bypassing out from the air inlet channel through the opening, for inhibiting the delivery of vaporized aerosolizable material when the aerosol provision system is in the second configuration.

2. An aerosol provision system according to claim 1, further comprising:

a consumable part; and a body comprising the air inlet channel, wherein the body is configured to releasably accommodate the consumable part, wherein the consumable part is releasably accommodated by the body in the first configuration, and the consumable part is not accommodated by the body in the second configuration.

3. An aerosol provision system according to claim 2, wherein the opening is configured to be covered by the consumable part when the aerosol provision system is in the first configuration.

4. An aerosol provision system according to claim 2, wherein the aerosol provision system further comprises a retaining member for gripping the consumable part when the aerosol provision system is in the first configuration, wherein the opening is configured to be covered by the retaining member when the aerosol provision system is in the first configuration.

5. An aerosol provision system according to claim 1, wherein the aerosol provision system comprises a puff sensor configured to permit the operation of the vaporizer in response to detecting a puff of air in the aerosol provision system, wherein the air inlet channel is configured such that air flowing through the opening bypasses the puff sensor.

6. An aerosol provision system according to claim 1, wherein the aerosol provision system comprises a reservoir for containing flavoring material, wherein the air inlet channel is configured such that air flowing through the opening bypasses the reservoir.

7. An aerosol provision system according to claim 1, wherein the aerosol provision system comprises a cavity configured to receive a flavoring material, wherein the air inlet channel is configured such that air flowing through the opening bypasses the cavity.

8. An aerosol provision system according to claim 1, wherein the aerosol provision system comprises a mouthpiece defining an outlet for vaporized aerosolizable material.

9. An aerosol provision system according to claim 8, wherein in the first configuration, the opening is located closer to the mouthpiece than the vaporizer is located to the mouthpiece.

10. An aerosol provision system according to claim 1, wherein the aerosol provision system is configured to switch between the first configuration and the second configuration in response to an electrical signal.

11. An aerosol provision system according to claim 1, wherein the aerosol provision system further comprises a button which is actuatable for moving the aerosol provision system between the first configuration and the second configuration.

12. A method for controlling the delivery of vaporized aerosolizable material in an aerosol provision system comprising a vaporizer and an air inlet channel, wherein the method comprises:

moving the aerosol provision system between a first configuration, in which an opening of the air inlet channel is covered for allowing air passing through the air inlet channel to reach the vaporizer, and a second configuration in which the opening is uncovered to allow air to bypass the vaporizer by bypassing out from the air inlet channel through the opening.

13. The method according to claim 12, wherein the method comprises moving the aerosol provision system from the second configuration to the first configuration.

14. The method according to claim 12, wherein the method comprises actuating a button from the aerosol provision system for moving the aerosol provision system from the second configuration to the first configuration.

15. The method according to claim 13, wherein the aerosol provision system further comprises a consumable part, and a body comprising the air inlet channel, and wherein the method further comprises:

moving the aerosol provision system from the second configuration to the first configuration by accommodating the consumable part in the body.

16. The method according to claim 12, wherein the method further comprises:

operating the aerosol provision system in the first configuration for allowing the vaporizer to receive air from the air inlet channel.

* * * * *